United States Patent [19]

Chouzenoux

[11] Patent Number: 5,039,179

[45] Date of Patent: Aug. 13, 1991

[54] STORAGE LOCKER IN PARTICULAR FOR SPORTS FACILITIES, SET OF LOCKERS, ROW OF LOCKERS AND CHANGING-ROOM EQUIPPED WITH SUCH LOCKERS

[75] Inventor: Gilbert Chouzenoux, Goussainville, France

[73] Assignee: Secretariat d'Etat Aupres du Premier Ministre Charge de la Jeunesse et des Sports, Paris, France

[21] Appl. No.: 348,493

[22] PCT Filed: Aug. 7, 1987

[86] PCT No.: PCT/FR87/00315

§ 371 Date: Mar. 2, 1989

§ 102(e) Date: Mar. 2, 1989

[87] PCT Pub. No.: WO88/01143

PCT Pub. Date: Feb. 25, 1988

[30] Foreign Application Priority Data

Aug. 11, 1986 [FR] France ..... 86 11575

[51] Int. Cl.[5] ..... A47B 81/00

[52] U.S. Cl. ..... 312/234; 312/329; 312/242

[58] Field of Search ..... 49/379; 312/139, 229, 312/242, 329, 234

[56] References Cited

U.S. PATENT DOCUMENTS

| | | | |
|---|---|---|---|
| 1,326,718 | 12/1919 | Finn | 312/138.1 X |
| 2,362,095 | 11/1944 | Ressinger | 312/138.1 X |
| 2,965,429 | 12/1960 | Stanger . | |
| 3,561,162 | 2/1971 | Goldman | 49/379 X |
| 4,690,467 | 9/1987 | Imbert | 312/229 X |
| 4,783,132 | 11/1988 | Baus | 312/138.1 X |

FOREIGN PATENT DOCUMENTS

| | | |
|---|---|---|
| 0081417 | 6/1983 | European Pat. Off. . |
| 2121216 | 2/1973 | Fed. Rep. of Germany . |
| 2312034 | 9/1974 | Fed. Rep. of Germany . |
| 944823 | 4/1949 | France . |
| 1003189 | 3/1952 | France . |
| 2069582 | 8/1981 | United Kingdom . |

*Primary Examiner*—Joseph Falk
*Attorney, Agent, or Firm*—Fidelman & Wolffe

[57] ABSTRACT

The invention relates to a storage locker for changing-rooms in sports facilities, for example. The locker comprises a semi-cylindrical chamber (1) in which is mounted a semi-cylindrical compartment (2) having a circular floor (4) and ceiling (5). The compartment (2) is mounted for rotation coaxially within the chamber (1) between a closed position in which the compartment (2) is outside the chamber (1) and an open position in which it is disposed therein. The compartment is biased towards the open position and away from the closed position. The lockers are drained and the compartment (2) stacked vertically in double rows with a common carcase providing the walls of the chambers (1). The lockers have electromagnetic locks and a computer providing a central supervisory and surveillance system providing warnings in response to alarm signals generated in response to abuse of the locks.

The invention is especially applicable to swimming-pool changing-rooms.

12 Claims, 7 Drawing Sheets

Figure 1:
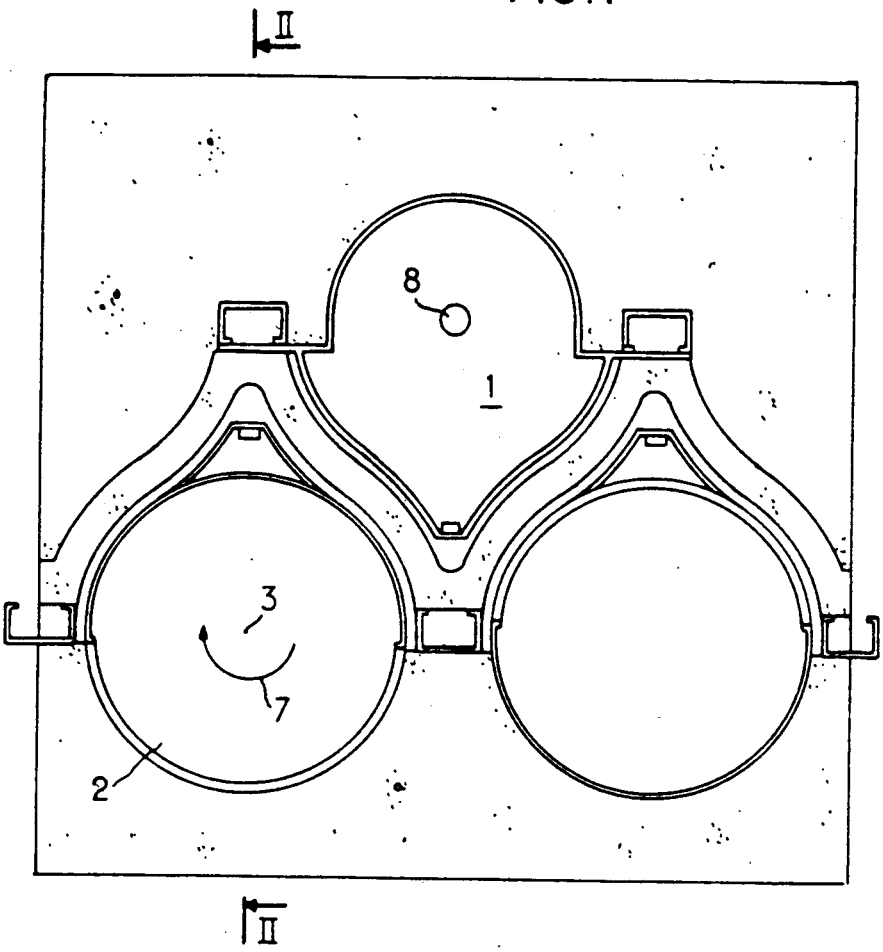

STORAGE LOCKER IN PARTICULAR FOR SPORTS FACILITIES, SET OF LOCKERS, ROW OF LOCKERS AND CHANGING-ROOM EQUIPPED WITH SUCH LOCKERS

This invention relates to a storage locker, particularly for use in sports facilities comprising a chamber of substantially semi-cylindrical shape and within which is disposed for coaxial rotation a compartment also of substantially semi-cylindrical shape and including a floor and ceiling of substantially circular shape.

Such a locker is described in particular in U.S. Pat. No. 2,965,429 and in French patent number 944 823.

When one tries to find a locker of this kind which is unoccupied, there are some difficulties, since the moveable compartment may happen to be in the closed position, but unlocked, so that one thinks that the locker is not available, although it is.

Moreover, it is advantageous to provide a device which enables the user to be warned that he has not properly closed his locker.

The present invention has an object a storage locker of the kind referred to above which enables the disadvantages described above to be avoided. It is particularly notable in that the said compartment is provided with a return device towards the open position and in that it comprises a locking device for the compartment comprising an elastic element, such as a spring, tending to urge the compartment away when it is in the closed position.

Because of the return device towards the open position, when the locker is not in use, the moveable compartment is automatically disposed in the open position, which enables the user to spot very quickly the available lockers. Moreover, the automatic placing of the compartments in the open position also facilitates the operation of cleaning.

Because the locking device includes an elastic element which urges the compartment away from the closed position, it is automatically sent to the open position; furthermore, this also enables the user to be warned that he has not properly closed his locker, since it will be opened fully and automatically. Advantageously, in this case, the set of chambers of a double row form a single carcase.

Another object of the invention is a changing-room comprising a plurality of rows of lockers, wherein said locking means of said locker is electrically actuable, and alarm means for generating an alarm signal in response to abuse of said locker, and surveillance means electrically connected to said locking means of said locker and comprising data processing means responsive to said alarm signals. This arrangement enables the whole changing-room to be surveilled from a central station, in which is located the data processing means that comprises a central computer and addressing means for addressing respective locking means, said locking means including respective micro-controllers for supervising the operation of said locking means.

Figure 6:
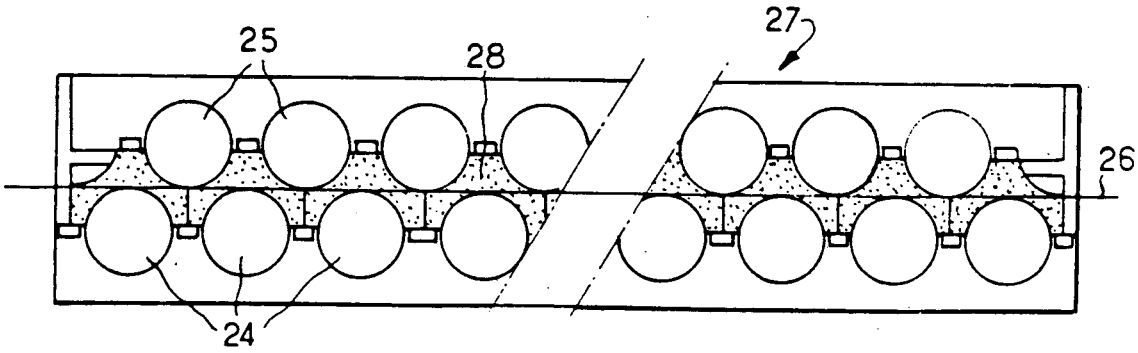
Figure 2:
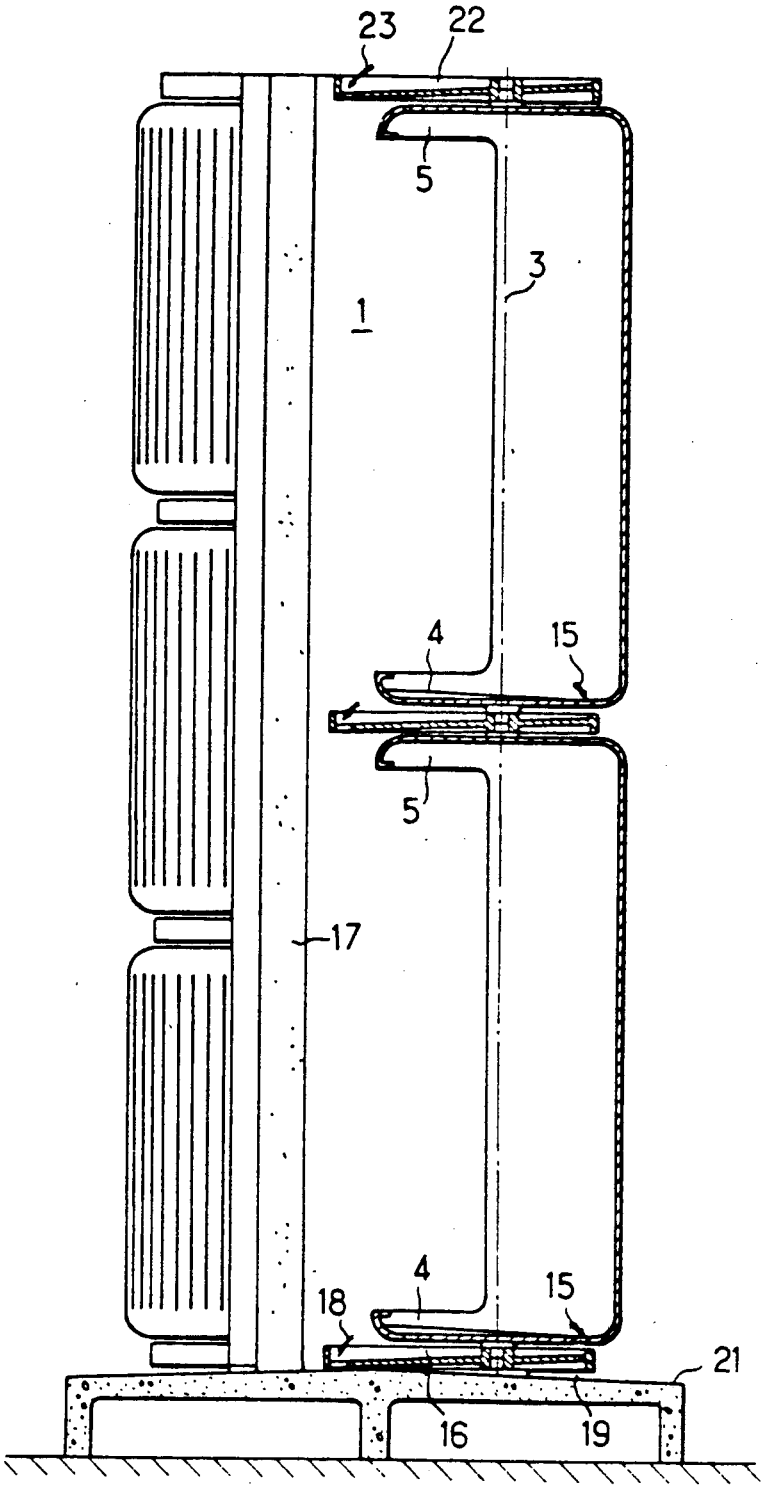
Figure 3:
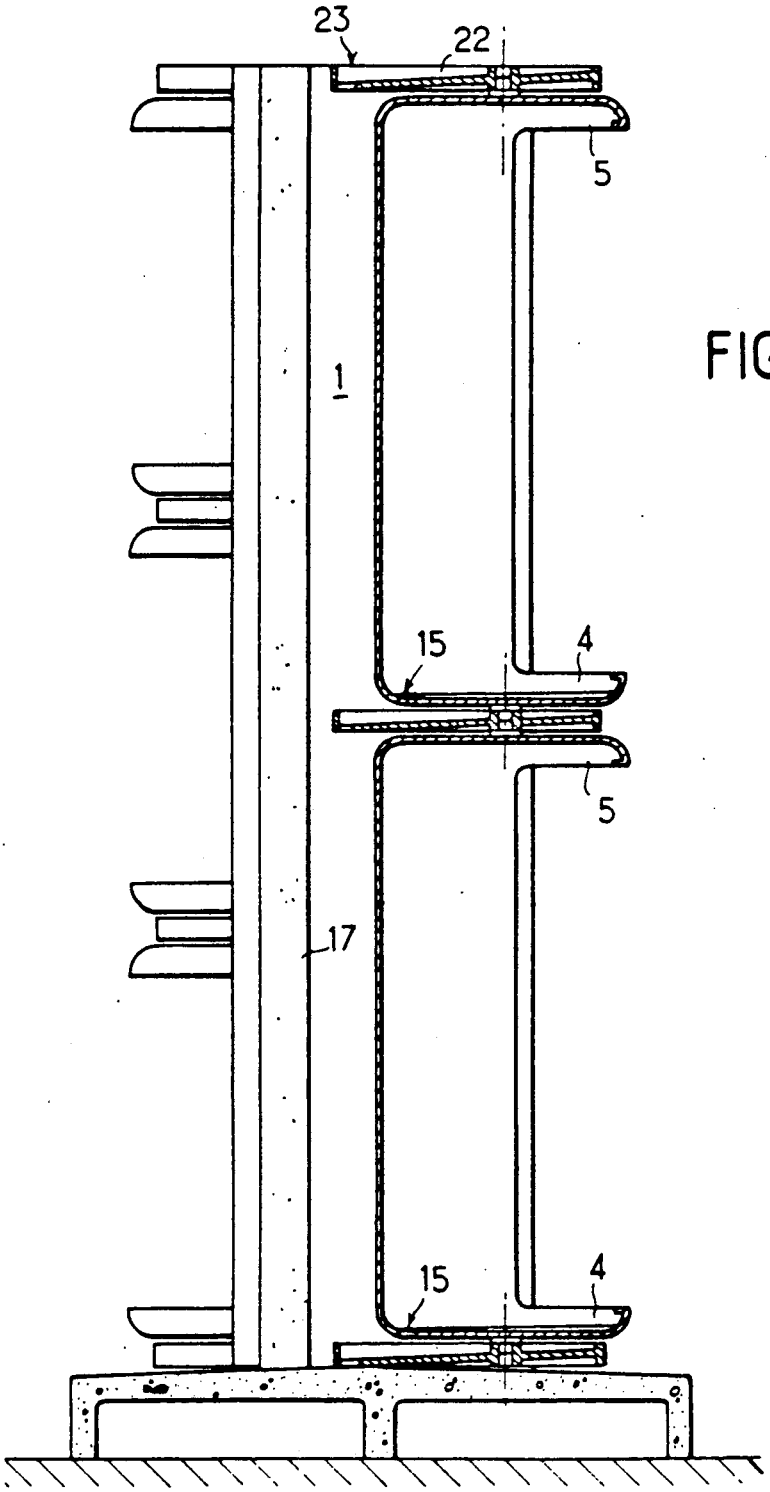
Figure 4:
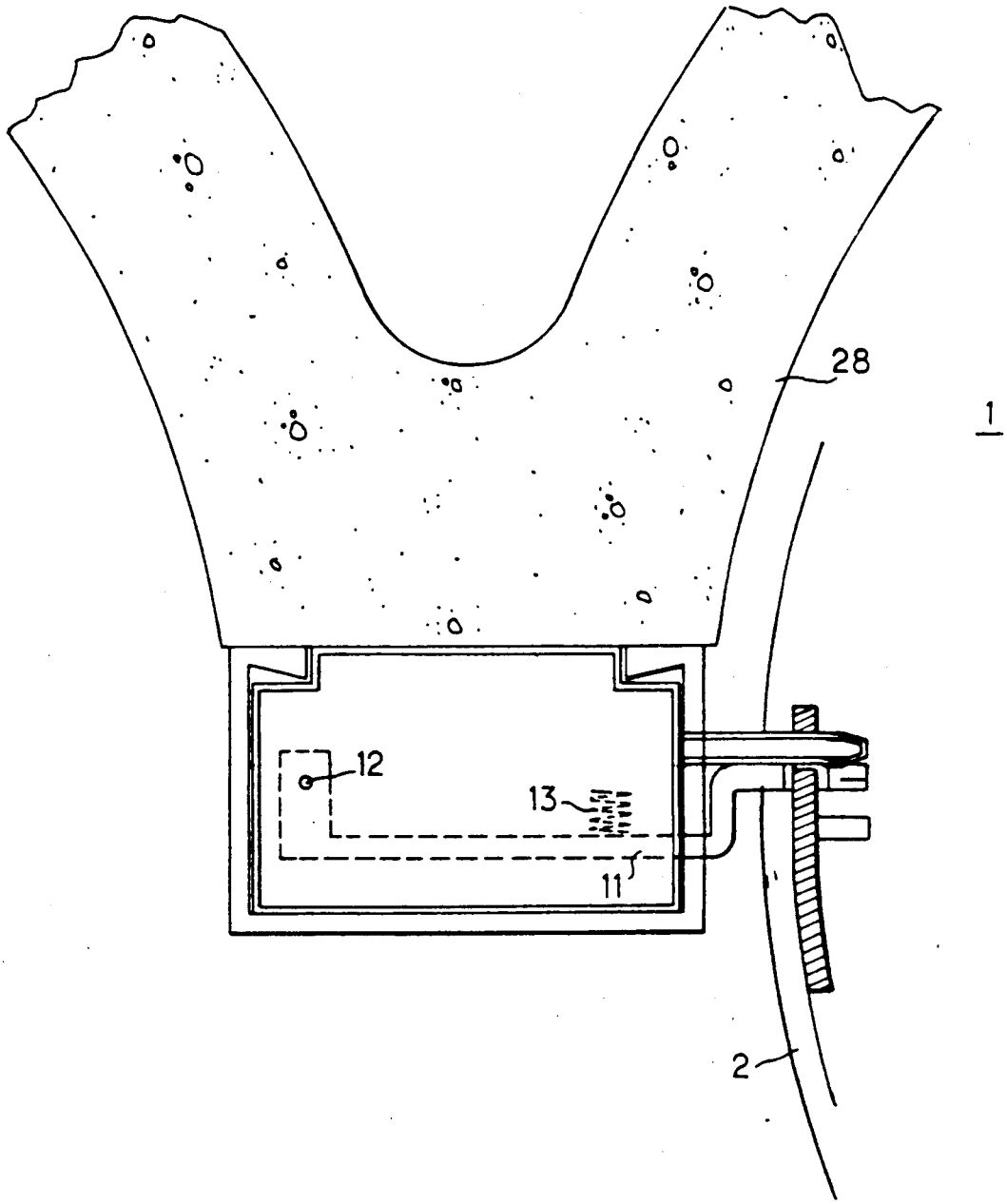
Figure 5:
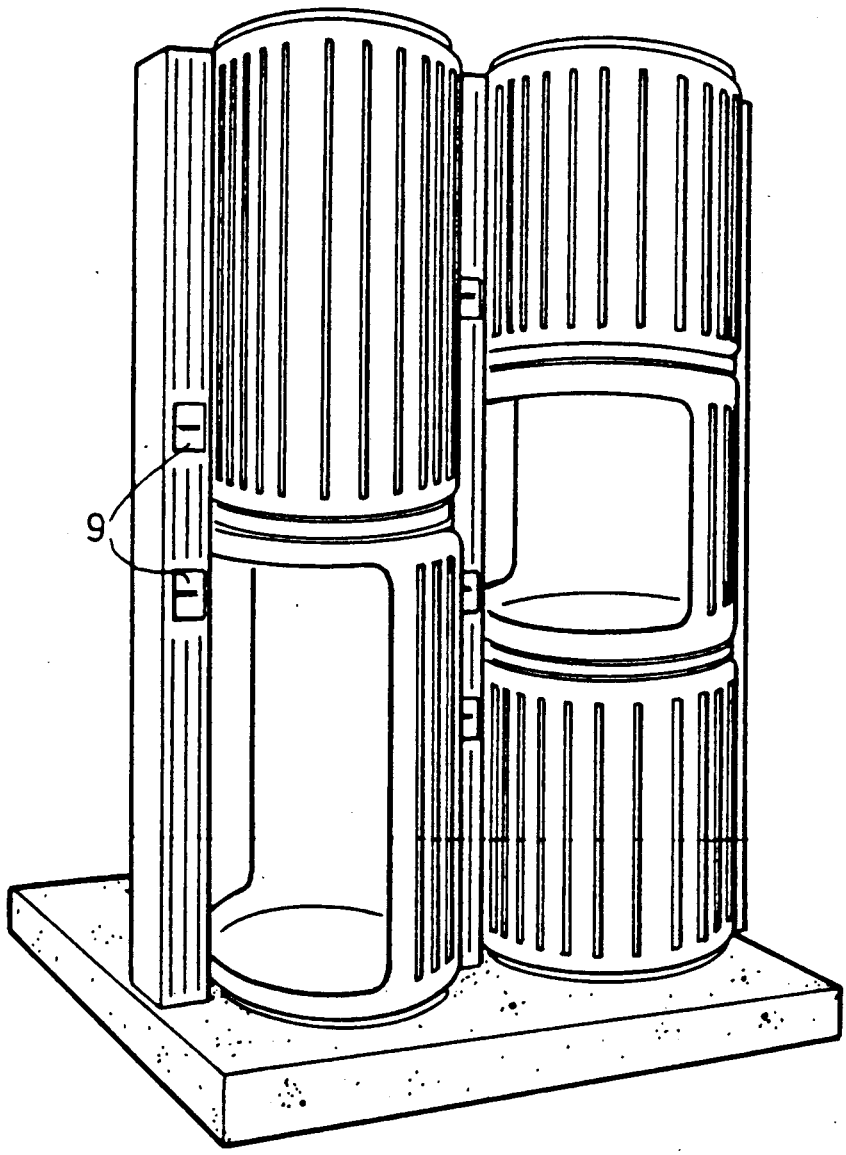
Figure 7:
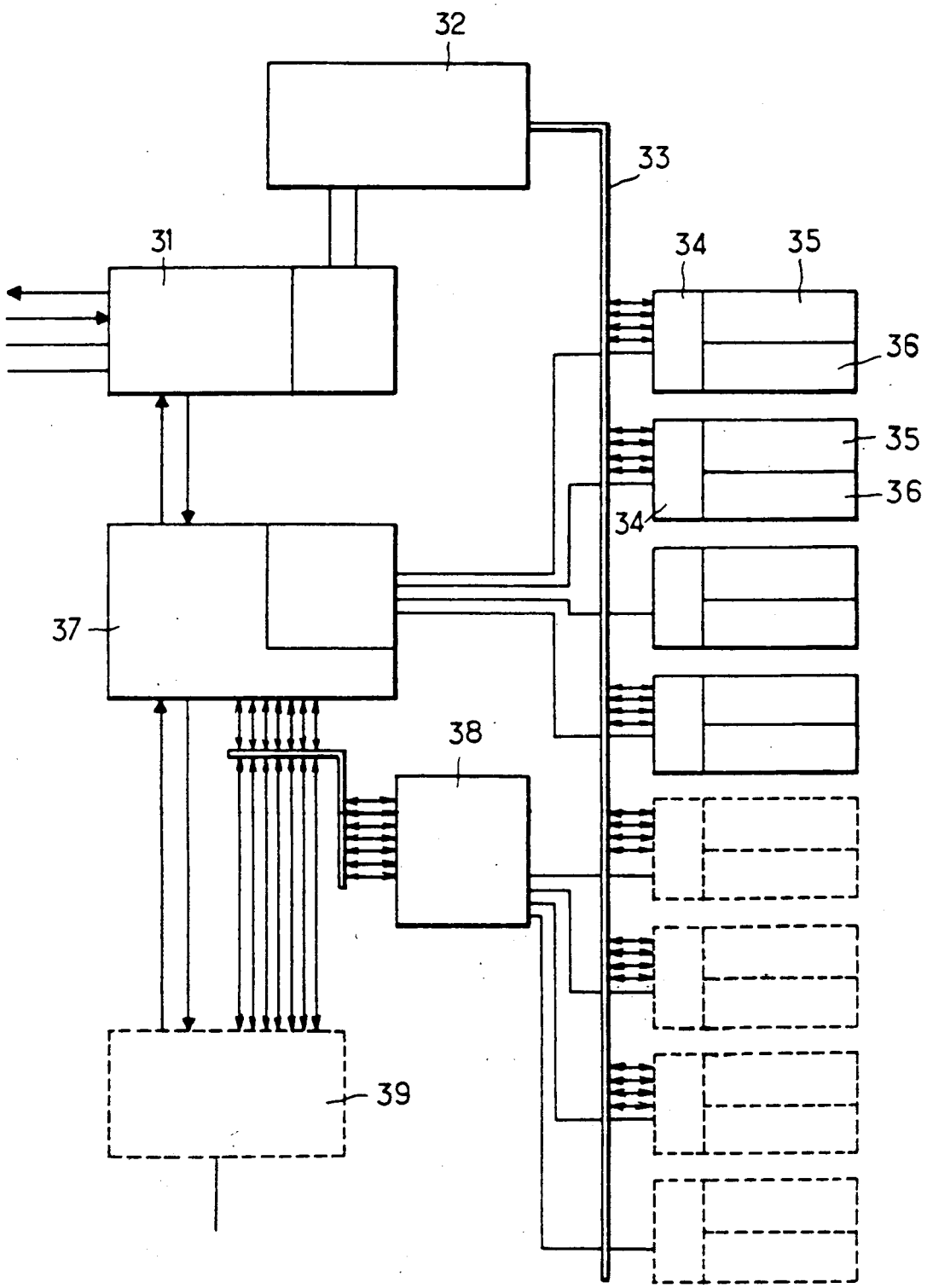
Figure 8:
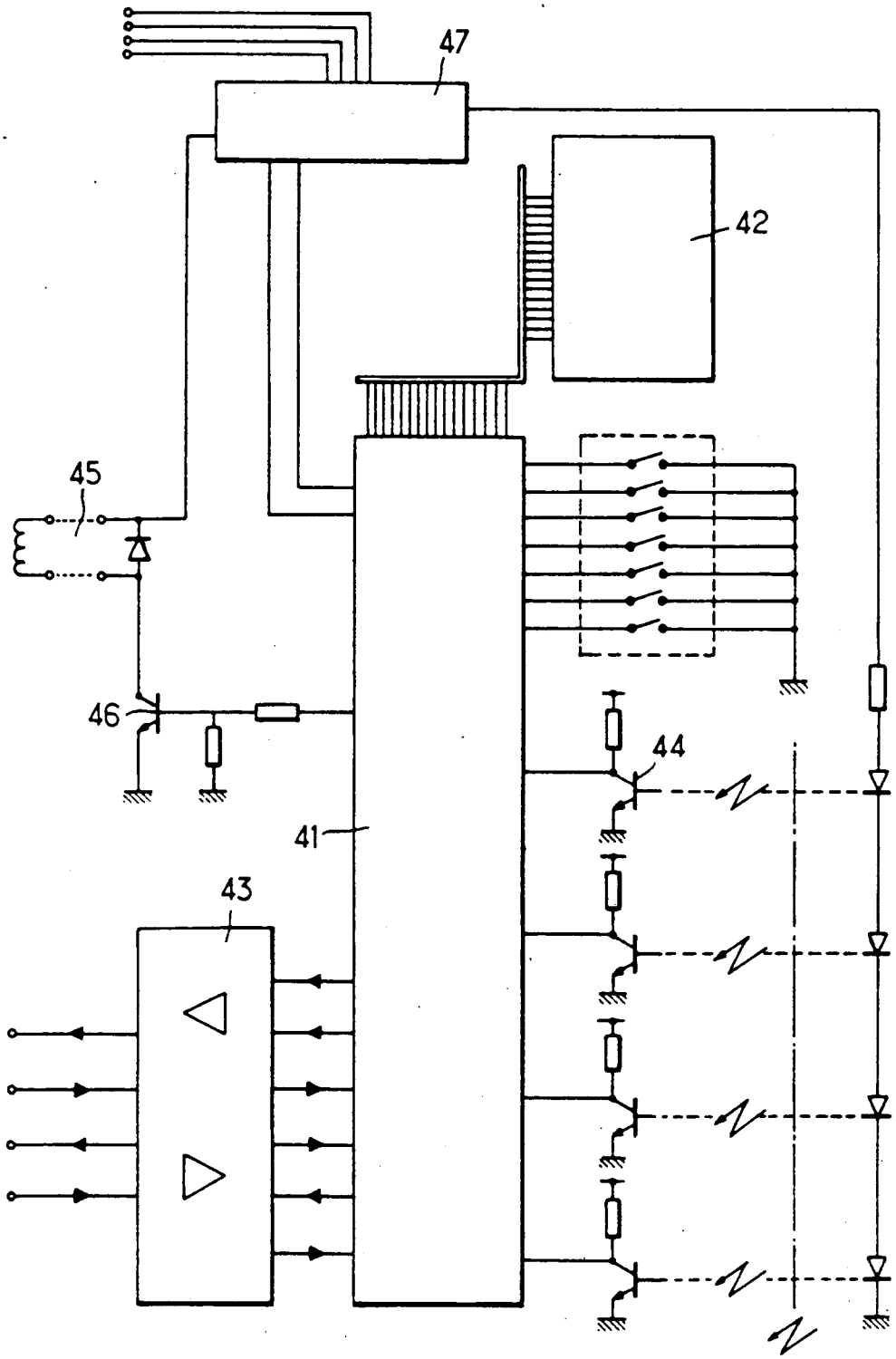

Other features and advantages of the invention will appear from the following description of embodiments thereof, given by way of example with reference to the accompanying drawings, in which:

FIG. 1 is a plan view of a set of lockers in accordance with an embodiment of the invention, FIG. 2 is a vertical sectional side view on the line II—II of FIG. 1, the lockers being closed, FIG. 3 is a view similar to that of FIG. 2 but with the lockers open, FIG. 4 is a horizontal sectional view of a detail of one of the lockers, showing a locking device, FIG. 5 is a perspective view of the set of lockers in FIG. 1, FIG. 6 is a plan view of a double row of lockers, FIG. 7 is a diagram showing a data processor, and FIG. 8 is a diagram of an electronic apparatus for a lock.

FIGS. 1, 2, 3 and 5 show a set of lockers in accordance with an embodiment of the present invention.

Each locker comprises a fixed chamber 1 whose shape is generally semi-cylinder and a compartment 2 which is also generally semi-cylindrical in shape and which is mounted for rotation coaxially within the chamber 1, that is to say the vertical axis 3 of the semi-cylinder forming the chamber is identical with the axis of the semi-cylinder of the compartment and forms the axis of rotation of the compartment. The diameter of the semi-cylinder forming the compartment is slightly less than the diameter of the chamber and the compartment also comprises a floor 4 and a ceiling 5 which are substantially inscribed on a circle centered on the axis 3. The compartment 2 is moveable between two positions, an open position in which the compartment 2 is accommodated within the chamber 1 and a closed position which is obtained by rotation through half a turn from the open position and in which the semi-cylindrical wall 6 of the compartment 2 is disposed outside the chamber 1 and facing towards the chamber so as to produce a substantially cylindrical volume. FIG. 1 shows an open locker below at the left and a closed locker below at the right, the upper locker being shown without its compartment.

To maintain the locker in its open position when it is not locked shut, a return member is provided to return the compartment in the direction of rotation indicated by the arrow 7 in FIG. 1; in the embodiment illustrated, the return member comprises a thrust bearing 8, shown in FIG. 1, and a spiral spring (not shown). Advantageously, the locking mechanism of each locker also comprises an elastic member such as a spring which tends to push the compartment away from the closed position. In the lock 9 shown in FIG. 4, the elastic member comprises a finger 11 pivoting about an axis 12 and subjected to the thrust of a spring 13. In this way, the user will immediately notice if he has failed to lock his locker, since it will immediately revert to the open position, and this is a first precaution against theft.

To facilitate cleaning and avoid accumulation of dirt in the compartment, the floor 4 is slightly inclined so as to converge towards the middle of the semi-cylindrical wall 6 and an orifice is provided at this point to drain accumulated water, as shown by the arrow 15 in FIGS. 2 and 3.

Similarly, the floor 16 of the chamber 1 is inclined so as to converge inwards, that is to say towards the middle of thee semi-cylindrical wall 17 of the chamber so as to facilitate draining as indicated by the arrow 18.

The compartment 2 which forms the locker itself is provided with features for receiving various objects which may be placed in the locker; these features may include a shelf for shoes, a shelf for a helmet, clothes-hooks or coat-hangers, a bag for receiving odd items and a strap which holds the garments in place within the compartment.

As a function of the intended use, superimposed sets of lockers may be provided, comprising a common chamber having a plurality of superimposed compartments. Thus, FIGS. 2 and 3 show on the left a stack of three compartments and on the right a stack of two compartments, the stacks being disposed in respective chambers of the same height. In this case, it is preferred to provide a chamber floor 16 for each compartment and the base 19 of the common chamber is inclined outwards so as to drain water evacuated by the drain holes of the chamber floors 16 as illustrated by the arrow 21. To obtain complete protection of the objects or clothing placed in the lockers, a cover 22 is provided for each chamber, or generally circular shape and inclined inwards, water accumulating therein draining through an orifice at its inner side as indicated by the arrow 23. As shown more particularly in FIGS. 2–3, the chamber floors 16 and the cover 22 project behind the compartment 1 so as to avoid water which drains at the rear of the floors 16 and cover 23 penetrating into the compartments 1.

The chamber 1 is preferably made of cast concrete to give good resistance to vandalism, the concrete being varnished to facilitate cleaning. The compartment is preferably made of metal (ribbed cast aluminum) or synthetic material such as polyethylene produced by roto-moulding. As shown in FIGS. 2, 3 and 5, a common chamber may house two lockers whose usable height is 1 meter or three lockers whose usable height is 65 cm. The outer face of the compartments is advantageously ribbed so as to reduce the risk of graffiti inscriptions or bill-sticking.

As shown more particularly in FIGS. 1 and 6, this embodiment of the invention enables a double row of lockers to be provided, opening on opposite sides of the double row, the space occupied being reduced by the two rows overlapping with the lockers 24 of the first row staggered relative to the lockers 25 of the second, the axes of the respective rows of lockers being disposed on opposite sides of the center-line of the double row 27. Thus, for example, the distance between the axes of the two rows of lockers 24 and 25 may be reduced to less than 40 cm, so that the overall width of the double row of lockers may be reduced to less than 80 cm, whereas each locker presents a usable volume extending over a cylinder of 40 cm diameter. This reduction in the widths of the double rows of lockers is additional to the reduction in the width of the alley between two double rows. In fact, due to the structure of the lockers in accordance with this embodiment of the invention, the lockers occupy the same space when open as shut and this enables a substantial reduction in the width of the alley ways; thus, for example, in the case of a swimming-pool changing-room, this reduction is of the order of 25%, the width of the alley being reduced from more than 1 meter to less than 80 cm.

In the case of a double row of lockers as shown in FIG. 6, the set of chambers is formed by a single carcase 28 which is advantageously made of concrete; this simplifies the building of the changing-room substantially since this single carcase may be cast in a single operation.

According to another feature of this embodiment of the invention, in particular for a changing-room including several rows of lockers, each locker has an electromechanical lock with an electronic control and the whole set of locks is connected to a data processor which treats the whole set of locks; in particular, each lock may include a device generating an alarm signal actuated if an attempt is made to force the lock of the locker. This alarm signal is transmitted to a central station which is immediately alerted and can take necessary measures. This enables more complete surveillance than by security rounds with reduced personnel.

In an embodiment of the invention, the electromagnetic locks are unlocked by introducing a "key" bearing a code which is attributed by the data processor at the moment when the entrance fee is paid. This key may, for example, comprise a perforate card which is read by an optical reader in the lock. Alternatively other devices for unlocking may be provided such as a set of push-buttons next to each lock on which the particular code of the lock is composed.

Besides the surveillance and transmission of an alarm in the ease of vandalism, the data processor may supervise the usage of the lockers, in particular, the data processor may continuously interrogate the lockers one after the other so as to determine which are available and attribute them to users paying their entrance fee. The alarm signal may be triggered by the introduction of the wrong key, mechanical forcing of the locker, or cutting off the electrical supply to a lock, for example.

FIGS. 7 and 8 illustrate an embodiment of the data processor supervising a changing-room having lockers, in accordance with the invention.

The complete data processor comprises a central supervisory computer having a memory of 256 kilo-octets and a disc of 10 mega-octets, together with an interface. These may be a micro-computer and an interface commercially available under the code RS232C. The micro-computer is associated with an encoder, sensors included in each of the electromagnetic locks and a central distributor which distributes messages to and from all the locks, which are grouped by alleys or sub-groups and which dialogues with the micro-computer. A basic software program supervises the locks and an adapted program enables the application of the first program to the characteristics of each changing-room and enables the supervision of the set of lockers by the micro-computer.

FIG. 7 is a diagram showing the central distributor referred to above; it comprises essentially the interface 31 mentioned above which is connected to the micro-computer (not shown), a supply unit 32 which comprises protection devices and the supply transformers and which supplies the different locks through a line 33 to which are connected supply units 34 each supplying two alleys 35 and 36 lockers, and a supervision apparatus 37 which supervises the exchanges between the micro-computer and a set of eight alleys in groups of two; the supervision unit 37 ay comprise an extension 38 enabling it to supervise eight other alleys. An extension apparatus 39 could also be provided for connection with a second distributor.

FIG. 8 shows the electrical circuit of a lock controlling the unlocking of a locker. The circuit comprises essentially a micro-controller 41 with a memory 42 and an alley interface 43. A decoder circuit for decoding the electronic kay controlling the lock is formed in this example by four photo-transistors 44, and is connected to the micro-controller 41 which also controls an electro-magnet 45 controlling the lock, for example through a Darlington transistor 46. The whole lock is supplied by a supply unit 47 including the protection devices.

The micro-controller performs the surveillance of all the locks, taking the initiative to transmit a message of "n" octets (4 octets in the example illustrated) during switching on, after a response from a peripheral or absence of response within a given time period. In response to this interrogation message, the micro-controller must receive a message of the same format corresponding either to a normal response or to the alarm message referred to above which has interrupted the normal procedure of interrogation and response. The central distributor analyses the first octet coming from the micro-controller and directs this message to one of the alleys after suppressing this first octet, if required, in the case where the normal interrogation procedure is to continue.

If a signal is detected on an alarm bus either during or just before reading the first octet, the micro-controller message is blocked. The central distributor then examines the alleys and finds those whose alarm bus has been actuated, the "alarm-response" bus is actuated and the lock concerned can send its alarm message either immediately or after scanning in the alley by the central distributor. The alarm message supplied by the lock is shaped by the central distributor and repeated to the micro-controller which can then interrogate the lock involved or continue scanning. In any case, the micro-controller defines the rythm of the messages and systematically receives a message in response to each message transmitted.

The supervision apparatus 37 of the central distributor processes or produces the first octets of the messages and distributes the periodic messages to the alleys while processing directly the alarm interruptions; the supply circuits 34 also have the role of communication interface with the corresponding alleys 35 and 36.

The locks are grouped by alley, the maximum number of locks per alley being 128; each alley has a specific supply and communication cable which comes from one of the halves of the supply and interface circuit 34.

As shown more particularly in FIG. 5, the locks of each locker are disposed in a vertical section upright forming a facing and which may be made of drawn aluminium for example and which is disposed on the facade of the modular concrete elements. The section advantageously forms a cover in which are accommodated the lock of each locker with its supply, if required, and an emergency unlocking device and which bears the reference numbers of the lockers.

This structure not only enables the possible alarms to be scanned rapidly, but also enables complete isolation of an alley in the case of a serious breakdown, without affecting the other alleys. The alley cable may have a branching connector for four neightbouring lockers, for example.

It will be appreciated that the embodiment of the invention illustrated in the drawings enables changing-rooms to be produced in a greatly reduced space with lockers which can readily be cleaned in good hygienic conditions; in particular, due to the various arrangements for draining accumulated water out of the lockers, and the shape of the lockers, dirt will not tend to accumulate; the locerks are cleaned when open, for example using a high pressure water jet and the inner wall of the chamber can be cleaned through the space left in the open position between the compartment and the chamber. Also the use of central computer surveillance enables a significant reduction in the surveillance personnel while improving the security of the installation.

What is claimed is:

1. A storage locker, especially for sports facilities comprising a chamber of substantially semi-cylindrical shape and within which is disposed for coaxial rotation a compartment also of substantially semi-cylindrical shape, said compartment having a floor and a ceiling of substantially circular shape centered on an axis of rotation of said compartment, said compartment being movable between and open position in which it is disposed within said chamber and a closed position in which it is disposed outside the chamber and completes the volume thereof, characterized in that said compartment is provided with a locking device and return device means for biasing said compartment to rotate towards the open position whenever said locking device is not latchingly engaged with said compartment in said closed position.

2. A storage locker as claimed in claim 1, characterized in that the chamber (1) comprises a lower wall (16) which is inclined and provided with at least one drain orifice and in that the floor (4) of the compartment (2) is inclined and is provided with at least one drain orifice.

3. A set of storage lockers as claimed in claim 1, characterized in that it comprises a single chamber (1) in which are superimposed a plurality of compartments.

4. A row of lockers or of sets of lockers as claimed in claim 1, characterized in that the lockers or sets of lockers are disposed in alternating manner staggered on opposite sides of the axis of the said row.

5. A row of lockers or of sets of lockers as claimed in claim 4, characterized in that said generally vertical parts of said chamber walls comprise a common carcase.

6. A changing-room comprising a plurality of rows of lockers as claimed in claim 4, wherein said locking device of each locker is electrically actuateable, and alarm means for generating an alarm signal in response to abuse of said locker, and surveillance means electrically connected to said locking device of each locker and comprising data processing means responsive to said alarm.

7. A changing-room as claimed in claim 6, wherein said data processing means comprises a central computer and addressing means for addressing respective locking devices, said locking devices including respective microcontrollers for supervising the operation of said locking devices.

8. A set of storage lockers as claimed in claim 2, characterized in that it comprises a single chamber (1) in which are superimposed a plurality of compartments.

9. A row of lockers or of sets of lockers as claimed in claim 2, characterized in that the lockers or sets of lockers are disposed in alternating manner staggered on opposite sides of the axis of said row.

10. A row of lockers or of sets of lockers as claimed in claim 3, characterized in that the lockers or set of lockers are disposed in alternating manner staggered on opposite sides of the axis of said row.

11. A changing-room comprising a plurality of rows of lockers as claimed in claim 5, wherein said locking device of each locker is electrically actuateable, and alarm means for generating an alarm signal in response to abuse of said locker, and surveillance means electrically connected to said locking device of each locker and comprising data processing means responsive to said alarm.

12. A changing-room as claimed in claim 11, wherein said data processing means comprises a central computer and addressing means for addressing respective locking devices, said locking devices including respective micro-controllers for supervising the operation of said locking devices.

* * * * *